US006834894B2

(12) United States Patent
Khaitan

(10) Patent No.: US 6,834,894 B2
(45) Date of Patent: Dec. 28, 2004

(54) APPARATUS FOR TYING KNOT AND METHOD THEREOF

(76) Inventor: Shree G. Khaitan, 71, Lake Road, Calcutta 700 029 (IN)

( * ) Notice: Subject to any disclaimer, the term of this patent is extended or adjusted under 35 U.S.C. 154(b) by 0 days.

(21) Appl. No.: 10/369,238

(22) Filed: Feb. 20, 2003

(65) Prior Publication Data

US 2004/0164556 A1 Aug. 26, 2004

(51) Int. Cl.[7] ..... D03J 3/00
(52) U.S. Cl. ..... 289/17; 289/1.5; 289/18.1
(58) Field of Search ..... 289/1.5, 17, 18.1; 43/4; 140/101, 102, 102.5, 103, 122, 123

(56) References Cited

U.S. PATENT DOCUMENTS 2,899,226 A * 8/1959 Lint ..... 289/17
3,866,959 A * 2/1975 Matarelli ..... 289/17
3,877,736 A * 4/1975 Zauskey ..... 289/17
4,008,913 A * 2/1977 Cole ..... 289/17
RE29,604 E * 4/1978 Matarelli ..... 289/17
6,026,607 A * 2/2000 Bukowski ..... 43/4

* cited by examiner

*Primary Examiner*—Gary L. Welch
(74) *Attorney, Agent, or Firm*—Raymond Y. Chan; David and Raymond Patent Group

(57) ABSTRACT

A knot tying apparatus includes a thread holding frame having a longitudinal axis. The thread holding frame includes an engaging arm having a catch end positioning aligned with the longitudinal axis for slidably engaging a tying thread in position; a thread holder having a rounded bottom end axially extended from the longitudinal axis and an arc-shaped holding groove communicating with the rounded bottom end for slidably holding the tying thread to form a loop thereof while the tying thread is capable of being released at the rounded bottom end of the thread holder, and a resilient element provided between the thread holder and the engaging arm such that the engaging arm is capable of bending towards the thread holder to reduce a distance between the catch end and the holding groove for providing a tension force on the loop of the tying thread.

7 Claims, 6 Drawing Sheets

APPARATUS FOR TYING KNOT AND METHOD THEREOF

BACKGROUND OF THE PRESENT INVENTION

1. Field of Invention

The present invention relates to an apparatus for fastening a knot, which is adapted for holding a tying thread in a tension manner so as to allow the user to easily and quickly tighten a final knot of the tying thread on an object without breaking the tying thread.

2. Description of Related Arts

A tying thread is considered as one of the common fastening elements to fasten two objects together by means of forming a knot thereon. Generally, a knot, which is an intertwined loop of the tying thread, must be made to firmly tighten up the tying thread to fasten the two objects together. Accordingly, the knot is formed to make a knob on the tying thread and by untwisting the strands at the end and weaving them together. But it may be made by turning the tying thread on itself through a loop, as for instance, the overhand knot.

In addition, in order to make a firm and secure knot, the major factor is the tension of the tying thread. If the tying thread is not tense enough to make the knot, the loops of the tying rope cannot be securely intertwined with the objects so that the objects cannot be tied up tightly. If the tying thread is too tense to intertwine the loops thereof with the objects, the tying thread may be broken before the knot is made. In other words, the knot requires a fairly high degree of dexterity and patience to tie.

For example, in order to make an artificial fly for luring the fish while fishing, a user must use the tying thread to tighten a fly tying material on a shaft of a hook which is small in diameter. Tying knots by hands requires a fairly high degree of hand and finger dexterity, especially a person who afflicted with arthritis may merely have a difficult time tying knots. Therefore, it can be quite difficult to manipulate the tying thread to properly form the knot, and even more difficult to see if the knot is being properly formed. As expected, an improperly formed knot can result in the hook becoming disengaged from the hook.

In fact, the most effective knots are typically the most complex knots. It is an aggravation for the user for performing the steps of forming the effective knot. As a result, the user either breaks the tying thread in excess of tension applied thereon or makes the knot that the feather is loosely fastened on the hook.

U.S. Pat. No. Re. 29,601, owned by Matarelli, discloses a whip finishing tool comprising slender element having a hook and a U-shaped intermediate portion for holding the tying thread in position, wherein the intermediate portion has a thread receiving channel for receiving the tying thread so that after the tying thread is intertwined with the shank of the hook, the tying thread is arranged to be received in the thread receiving channel to form the final knot. However, the whip finishing tool cannot provide a tension force on the tying thread so that the user must pull the tying thread to retain the tying thread in a tension manner, which may break the fine tying thread accidentally. Moreover, when the tying thread is positioned within the thread receiving channel, the tying thread must be released from the thread receiving channel to form a loop for the final knot. However, once the tying thread is received within the thread receiving channel, the user is hard to pull out the tying thread therefrom unless the typing thread must be get loosen from the intermediate portion of the slender element, so that the final knot may be made improperly.

Another U.S. Pat No. 4,008,913, owned by Cole, discloses a fly-ties tool which comprises a thread engaging member and a hook shaped end member to hold the tying thread in position. However, the fly-ties tool cannot provide any tension force on the tying thread for holding it tensely. In addition, once the tying thread is engaged with the hook shaped end member, the tying thread cannot easily disengaged therewith to form the loop for the final knot.

SUMMARY OF THE PRESENT INVENTION

A main object of the present invention is to provide a tying knot apparatus, which is adapted for holding a tying thread in a tension manner so as to allow the user to easily and quickly tighten a final knot of the tying thread on an object without breaking the tying thread.

Another object of the present invention is to provide a tying knot apparatus, which comprises a resilient element for applying an urging force against the tying thread in a tension manner between a thread holder and an engaging arm such that when the tying thread is pulled to form a knot on an object, the resilient arm is arranged to bend towards the thread holder to keep the tying thread in a tension manner, so that the knot is firmly and securely tied on the object.

Another object of the present invention is to provide a tying knot apparatus, which enable the final knot, such as a whip finishing knot, to be made rapidly and precisely, wherein the tying thread does not become disengaged from the tying knot apparatus until the final knot is completed.

Another object of the present invention is to provide a tying knot apparatus, wherein the thread holder has an arc shaped holding groove not only for retaining the tying thread in position but also for ensuring the release of the tying thread at the bottom end of the thread holder while forming the knot.

Another object of the present invention is to provide a tying knot apparatus, wherein the tying operation of the knot of using the tying knot apparatus is easy and simply that by turning the engaging arm around the object to intertwine the tying thread therearound and releasing the tying thread on the thread holder to form the knot.

Another object of the present invention is to provide a tying knot apparatus, wherein no expensive or complicated structure is required to employ in the present invention in order to achieve the above mentioned objects. Therefore, the present invention successfully provides an economic and efficient solution for tying a firm and proper knot on the object.

Accordingly, in order to accomplish the above objects, the present invention provides a tying knot apparatus, comprising:

a thread holding frame having a longitudinal axis and comprising:

an engaging arm having a catch end positioning aligned with the longitudinal axis for slidably engaging a tying thread in position;

a thread holder, which is extended from the engaging arm, having a rounded bottom end axially extended from the longitudinal axis and an arc-shaped holding groove communicating with the rounded bottom end wherein the holding groove is adapted for slidably holding the tying thread to form a loop thereof while the tying thread is capable of being released at the rounded bottom end of the thread holder; and a resilient element provided between the thread holder and the engaging arm such that the engaging arm is capable of bending towards the thread holder to reduce a distance between the catch end of the engaging arm and the holding groove of the thread holder for providing a tension force on the loop of the tying thread.

These and other objectives, features, and advantages of the present invention will become apparent from the following detailed description, the accompanying drawings, and the appended claims.

DETAILED DESCRIPTION OF THE PREFERRED EMBODIMENT

Figure 1:
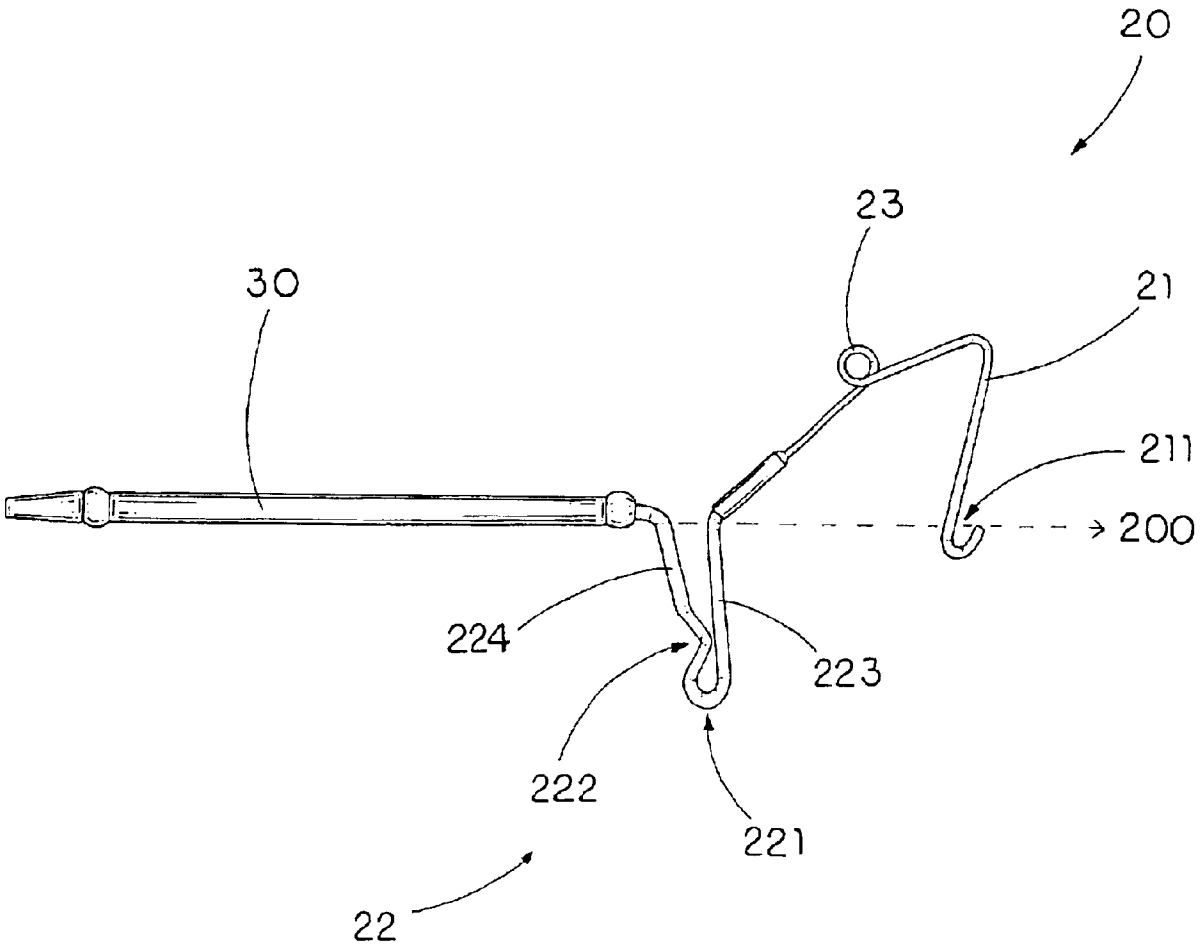
FIG. 1 is a side view of a knot tying apparatus according to a first preferred embodiment of the present invention.

Referring to FIG. 1 of the drawings, a knot tying apparatus according to a first preferred embodiment of the present invention is illustrated, wherein a user is able to manipulate the knot tying apparatus to quickly and precisely form a final knot on an object with minimum exercise of skill.

According to the first preferred embodiment, the knot tying apparatus comprises a thread holding frame 20 having a longitudinal axis 200 and comprising an engaging arm 21 having a catch end 211 positioning aligned with the longitudinal axis 200 for slidably engaging a tying thread 13 in position, and a thread holder 22, which is extended from the engaging arm 21, having a rounded bottom end 221 axially extended from the longitudinal axis 200 and an arc-shaped holding groove 222 communicating with the rounded bottom end 221 wherein the holding groove 222 is adapted for slidably holding the tying thread 13 to form a loop thereof while the tying thread 13 is capable of being released at the rounded bottom end 221 of the thread holder 22.

The thread holding frame 20 further comprises a resilient element 23 provided between the thread holder 22 and the engaging arm 21 such that the engaging arm 21 is capable of bending towards the thread holder 22 to reduce a distance between the catch end 211 of the engaging arm 21 and the holding groove 222 of the thread holder 22 for providing a tension force on the loop of the tying thread 13.

In order to provide a better illustration of the present invention, the knot tying apparatus is embodied as a whip finishing tool for tying a whip finishing knot as the final knot on an artificial fishing fly wherein the fishing fly is generally made of a hook 11 having a shaft 111, and a fly tying material 12 or a lure, such that the tying thread 13 securely intertwined the fly tying mater 12 with the shaft 111 of the hook 11 by the whip finishing knot.

Figure 2:
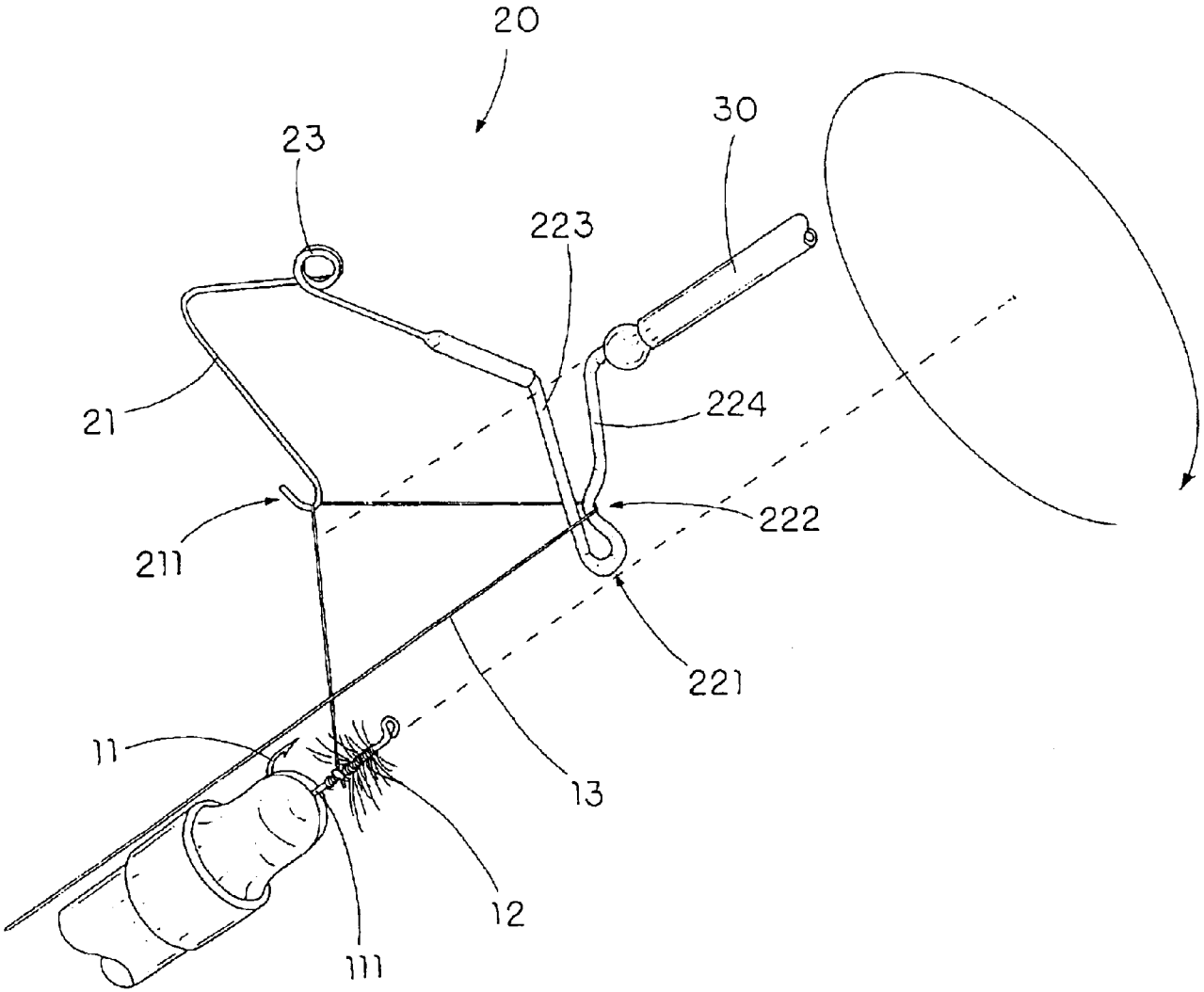
FIG. 2 is a perspective view of the knot tying apparatus incorporating with a conventional vice to make a whip finishing knot on the fly according to the above first preferred embodiment of the present invention.

As shown in FIG. 2, the thread holding frame 20 is made of rigid slender material such as steel for substantially holding the tying thread 13 between the catch end 211 of the engaging arm 21 and the holding groove 222 of the thread holder 22 to form the loop of the tying thread 13.

The engaging arm 21, having a L-shaped, is frontwardly extended from the thread holder 22 wherein the catch end 211 of the engaging arm 21 is shaped as a hook to engage with the tying thread 13 in position.

The thread holder 22 comprises a first holder arm 223 extended from the resilient element 23 and a second holder arm 224 integrally extended from the first holder arm 223 to form a U-shaped structure with the rounded bottom end 221 of the thread holder 22 wherein the second holder arm 224 is bent to form the holding groove 222 to communicate with the rounded bottom end 221 of the thread holder 22.

The resilient element 23, according to the preferred embodiment, is a coil spring having two ends extended from the engaging arm 21 and the first holder arm 223 of the thread holder 22 in such a manner that the resilient element provides an urging force against the engaging arm 21 to bend towards the thread holder 22. In addition, the thread holding frame 20 is constructed as a one-piece integral member wherein the resilient element 23 is integrally extended between the engaging arm 21 and the thread holder 22. Therefore, the manufacturing process of the thread holding frame 20 is in low cost and simple that by twisting a slender element such as wire to integrally form the engaging arm 21, the thread holder 22, and the resilient element 23.

Accordingly, the tying thread 13 is arranged to engage with the catch end 211 of the engaging arm 21 and the holding groove 222 of the thread holder 22 to form the loop of the tying thread 13 for the whip finishing knot. When one end of the tying thread 13 is pulled to reduce the size of the loop of the tying thread 13, the catch end 211 of the engaging arm 21 is forced to pull towards the thread holder 22 by means of the resilient element 23. At the same time, the resilient element 23 applies the tension force on the tying thread 13 so that the loop of the tying thread 13 is remained in a tensely tight manner and the distance between the catch end 211 of the engaging arm 21 and the holding groove 222 of the thread holder 22 is reduced. In addition, the tension force on the tying thread 13 is self-adjusted by the resilient element 23 such that no external pulling force is required to pull the tying thread 13 to break the tying thread 13 accidentally.

As shown in FIG. 2, the knot tying apparatus further comprises a handle frame 30 rearwardly extended from the thread holding frame 20 and aligned with the longitudinal axis 200 to control the thread holding frame 20 in a rotatably movable manner about the longitudinal axis 200.

Figure 3A:
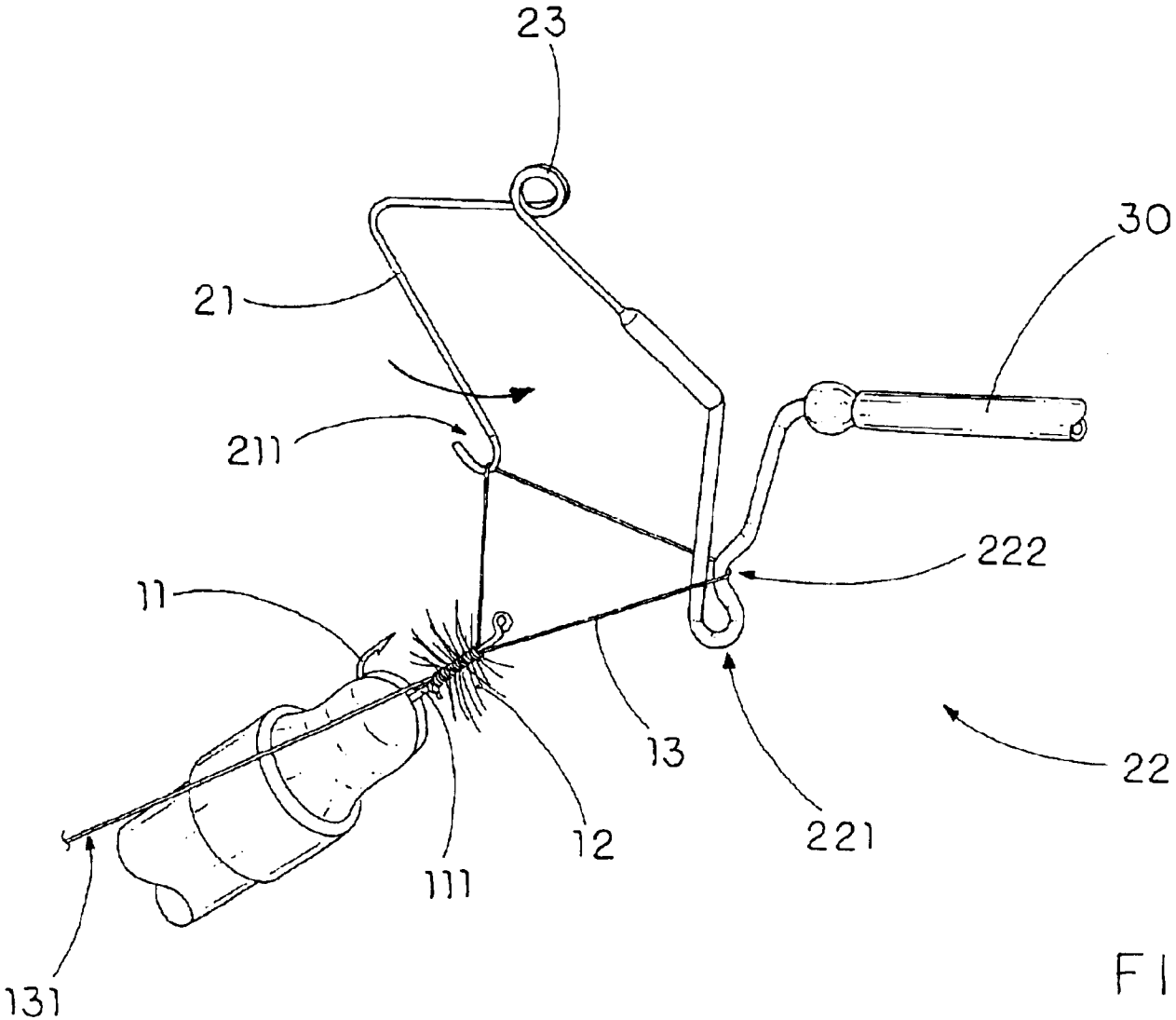
FIGS. 3A to 3C illustrate sequential steps in forming the whip finishing knot with the knot tying apparatus according to the above first preferred embodiment of the present invention.
Figure 3B:
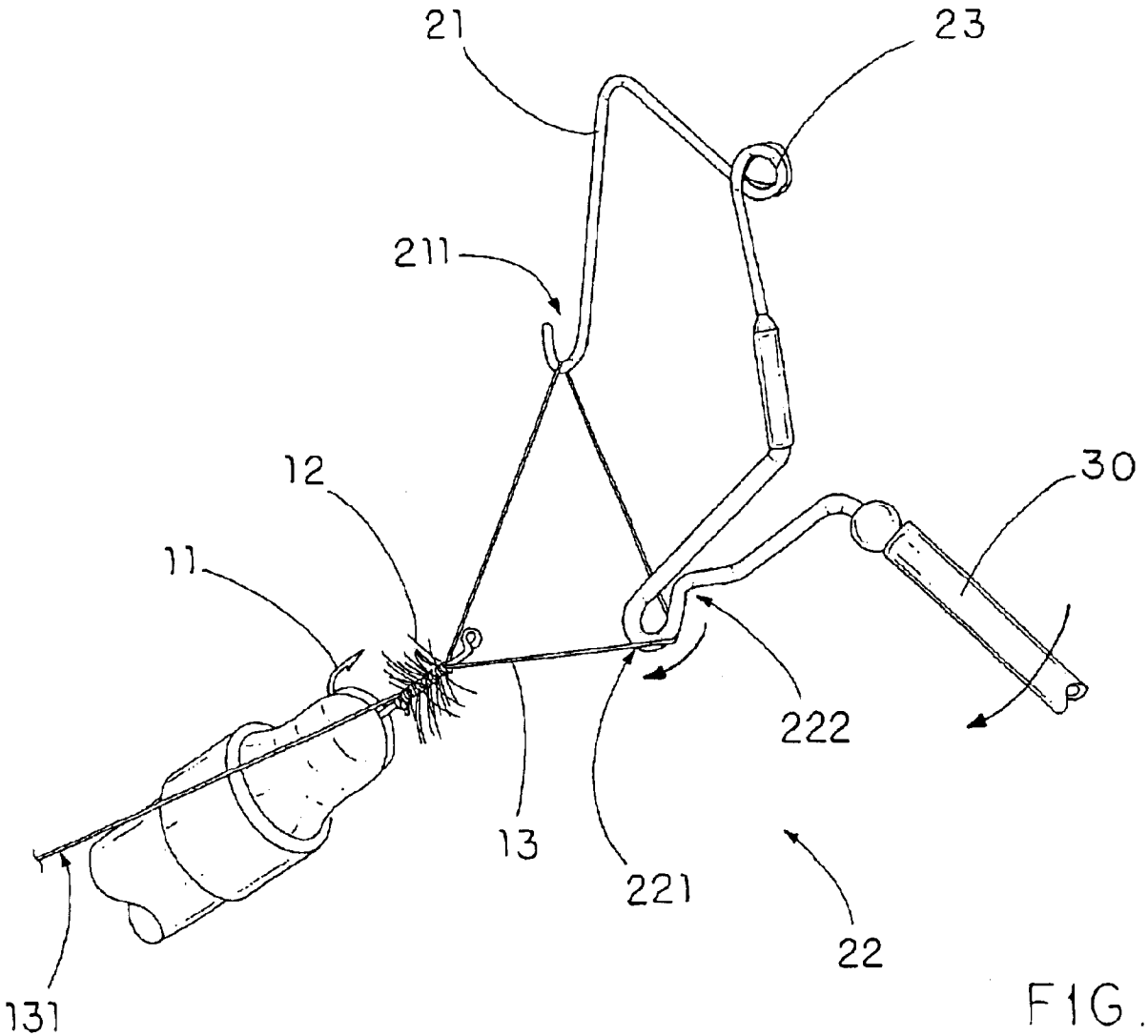
Figure 3C:
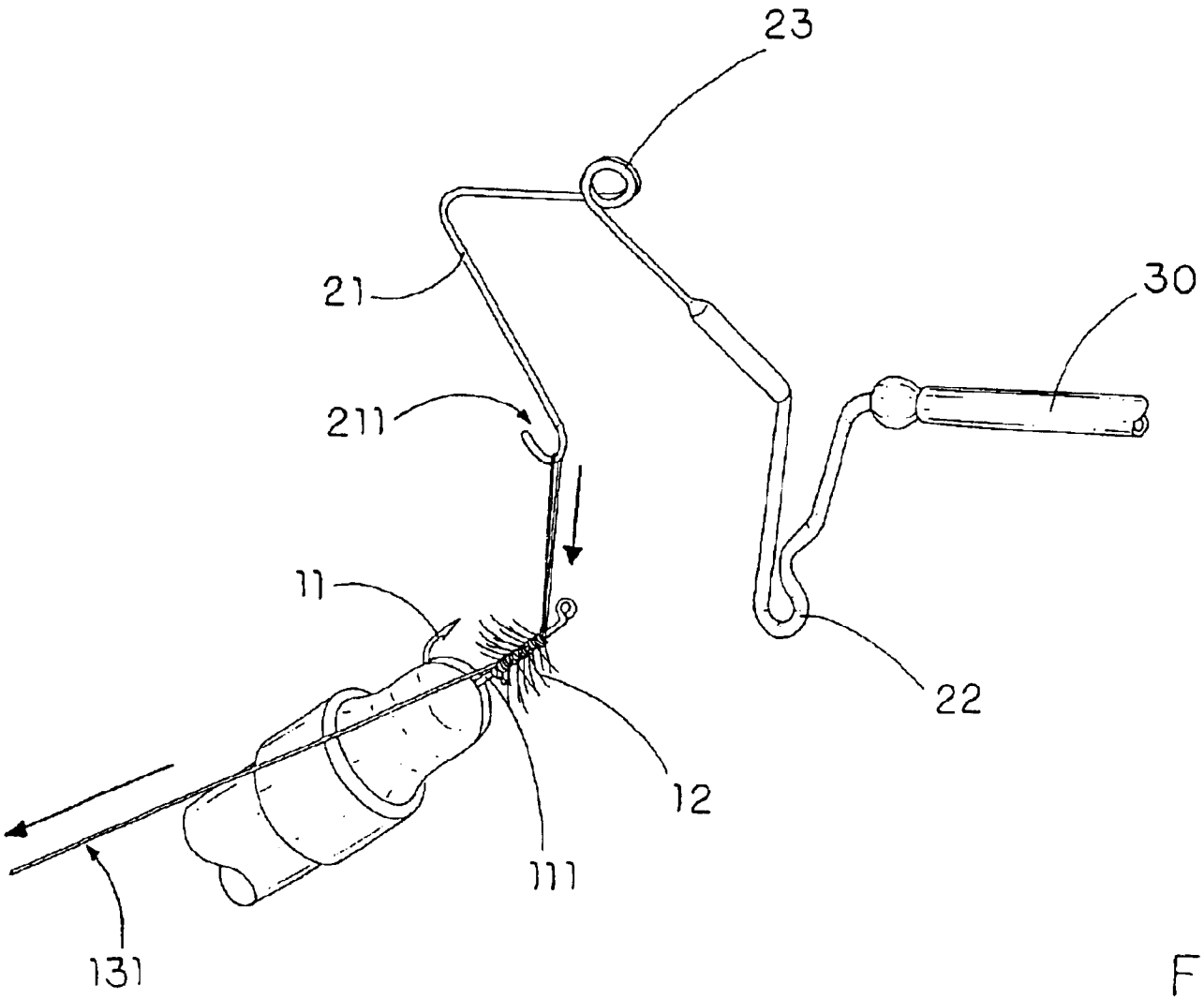

FIGS. 3A to 3C illustrate the operation of the knot tying apparatus of the present invention in actual use for forming the whip finishing knot, wherein the hook 11 is securely held by a supporting vice. It is worth to mention that for better illustration, the size of the fishing fly is not proportional to the actual size of the knot tying apparatus. In actual practice, the hook 11 is relatively tiny and the tying thread 13 is relatively fine in comparison with the actual size of the knot tying apparatus of the present invention.

As shown in FIGS. 2 and 3A, the hook 11 is held by the supporting vice while the shaft 111 of the hook 11 is positioned at a horizontal manner while the fly tying material 12 is secured on the shaft 111 of the hook 11. Then, the tying thread 13 is arranged to engage with the catch end 211 of the engaging arm 21 and slidably hold at the holding groove 222 of the thread holder 22 to form the loop of the tying thread 13 having a triangular shape. At this moment, the longitudinal axis 200 of the thread holding frame 20 is preferred to axially align with the shaft 111 of the hook 11. With the knot tying apparatus initially held as in FIG. 2, the user is able to rotate the handle frame 30 about the shaft 111 of the hook 11 as shown in FIG. 3A, such that the tying thread 13 is coiled around the shaft 111 of the hook 11 towards the hook eye thereof wherein the number of coils are determined by the number of turns of the handle frame 30 about the shaft 111 of the hook 11 as desired.

It is worth to mention that while coiling the tying thread around the shaft 111 of the hook 11, the size of the loop of the tying thread 13 formed by the thread holding frame 20 is reduced. Due to the resilient element 23, the engaging arm 21 is pulled towards the thread holder 22 so as to remain the loop of the tying thread 13 in the tensely tight manner. In other words, the loop of the tying thread 13 is retained by the engaging arm 21 until the tying thread 13 is released as the tying thread 13 is drawn tight to form the whip finishing knot on the shaft 111 of the hook 11. Therefore, the tension force applied by the resilient element 23 will retain on the loop of the tying thread 13 at the holding groove 222 to prevent the tying thread 13 sliding out of the thread holder 22 at the rounded bottom end 221 thereof.

In addition, since the size of the loop of the tying thread 13 can be tensely adjusted by the position of the engaging arm 21 via the resilient element 23, the supply of the tying thread 13 does not have to be released as required in the conventional whip finishing tool as mentioned in the background. Therefore, the present invention not only provides sufficient tension to the tying thread 13 for coiling around the shaft 111 of the hook 11 but also reduces the probability of breaking the tying thread 13 while releasing the supply of the tying thread 13.

When the desired number of turns of the tying thread 13 are formed on the shank 111 of the hook 11, the user is able to pivotally move the handle frame 30 so that the tying thread 13 held at the holding groove 222 is arranged to release at the rounded bottom 221 of the thread holder 22 while the catch end 211 of the engaging arm 21 still retains the loop of the tying thread 13, as shown in FIG. 3B. It is worth to mention that the rounded bottom end 221 of the thread holder 22 allows the quick release of the tying thread 13 from the holding groove 222 of the thread holder 22.

Then, the user is able to pull the supply end 131 of the tying thread 13 away from the knot tying apparatus to gradually disappear the loop of the tying thread 13 held at the catch end 211 of the engaging arm 21, as shown in FIG. 3C. Once the catch end 211 of the engaging arm 21 is pulled close to the shank 111 of the hook 11, the user is able to disengage the catch end 211 of the engaging arm 21 with the tying thread 13 such that the coils of the tying thread 13 are tightened by pulling the supply end 131 of the tying thread 13 along the shank 111 of the hook 11 and the whip finishing knot is completed.

Figure 4:
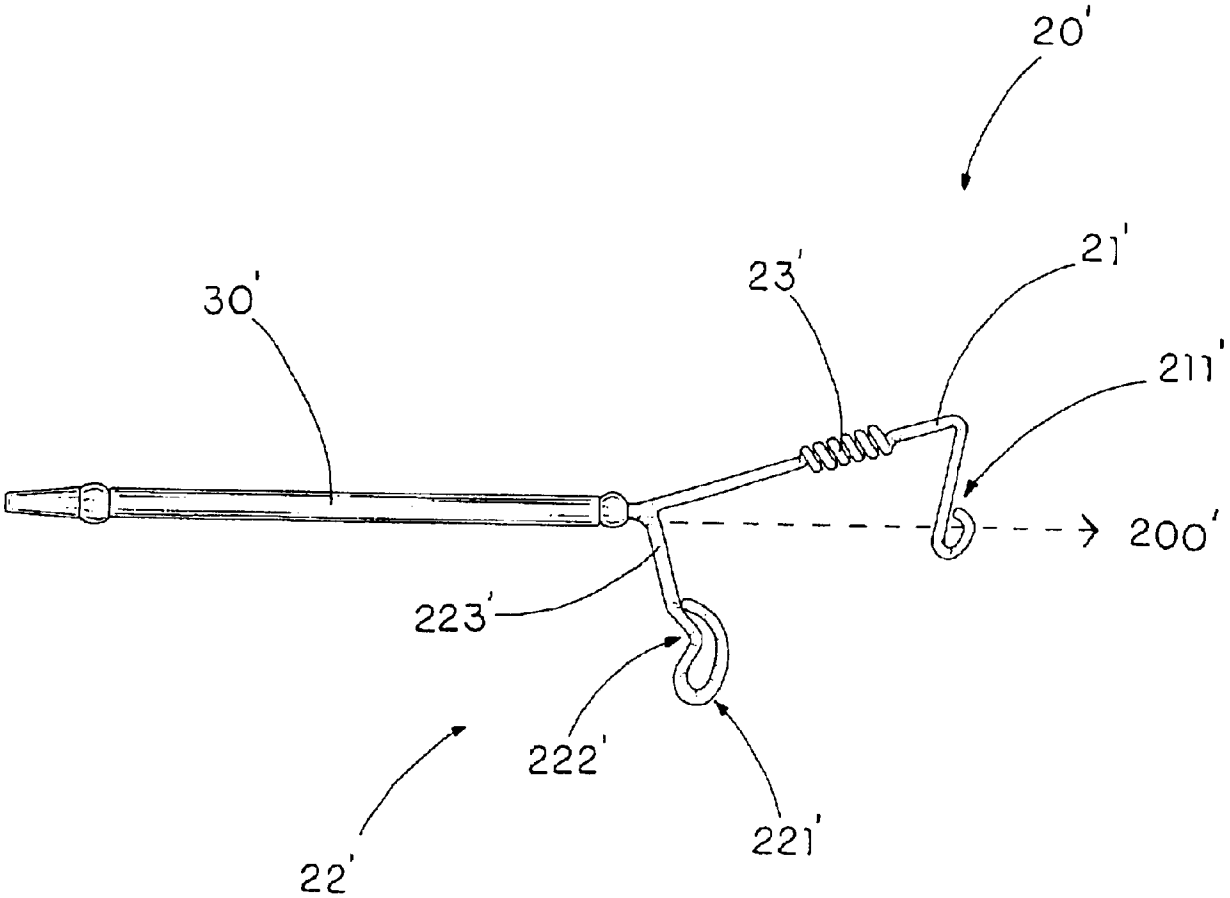
FIG. 4 is a perspective view of a knot tying apparatus according to a second preferred embodiment of the present invention.

As shown in FIG. 4, a knot tying apparatus of a second embodiment illustrates an alternative mode of the first embodiment of the present invention, wherein the knot tying apparatus comprises a thread holding frame 20' having a longitudinal axis 200' and a handle frame 30' rearwardly extended from the thread holding frame 20' and aligned with the longitudinal axis 200'. The thread holding frame 20' comprises an engaging arm 21' having a catch end 211', a thread holder 22' having a rounded bottom end 221 ' and a holding groove 222' communicating with the rounded bottom end 221', and a resilient element 23' provided between the engaging arm 21' and the thread holder 22'.

According to the second embodiment, the engaging arm 21' is frontwardly extended from the thread holder 22' while the catch end 211 ' of the engaging arm 21' is positioned alignedly with the longitudinal axis 200'. The catch end 211 ' of the engaging arm 21' is bent to have an O-shape, having an opening, to engage with the tying thread 13 in position.

The thread holder 22' comprises a holder arm 223' transversely extended away from the longitudinal axis 200' wherein a free end of the holder arm 223' is bent to form the rounded bottom end 221' and the holding groove 222' at the ridge of the rounded bottom end 221' of the holder arm 223'.

The resilient element 23', according to the preferred embodiment, is a compression spring having two ends extended from the engaging arm 21' and the holder arm 223' of the thread holder 22' in such a manner that the engaging arm 21' is capable of being bent towards the thread holder 22' via the resilient element 23'.

The operation of the knot tying apparatus according to the second embodiment is the same as that of the first embodiment, wherein the catch end 211' of the engaging arm 21' is disengaged with the tying thread 13 by releasing the tying thread 13 through the opening of the catch end 211' of the engaging arm 21'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A knot tying apparatus, comprising:

a thread holding frame having a longitudinal axis and comprising:

an engaging arm having a catch end positioning aligned with said longitudinal axis for slidably engaging a tying thread in position;

a thread holder, which is extended from said engaging arm, having a rounded bottom end axially extended from said longitudinal axis and an arc-shaped holding groove communicating with said rounded bottom end wherein said holding groove is adapted for slidably holding said tying thread to form a loop thereof while said tying thread is capable of being released at said rounded bottom end of said thread holder;

a resilient element provided between said thread holder and said engaging arm such that said engaging arm is capable of bending towards said thread holder to reduce a distance between said catch end of said engaging arm and said holding groove of said thread holder for providing a tension force on said loop of said tying thread, and a handle frame rearwardly extended from said thread holding frame and aligned with said longitudinal axis, whereby, when said loop of said tying thread is tensely formed at said catch end of said engaging arm and said holding groove of said thread holder, said thread holding frame is rotated about an object via said handle frame such that said tying thread is coiled around said object with predetermined number of turns in a tensely tight manner, so that said loop of said tying thread is adapted to be released at said holding groove of said thread holder through said rounded bottom end thereof while said loop of said tying thread is retained by said engaging arm until said tying thread is released as said tying thread is drawn tight to form a final knot on said object.

2. A knot tying apparatus, comprising:

a thread holding frame having a longitudinal axis and comprising:

an engaging arm having a catch end positioning aligned with said longitudinal axis for slidably engaging a tying thread in position;

a thread holder, which is extended from said engaging arm, having a rounded bottom end axially extended from said longitudinal axis and an arc-shaped holding groove communicating with said rounded bottom end wherein said holding groove is adapted for slidably holding said tying thread to form a loop thereof while said tying thread is capable of being released at said rounded bottom end of said thread holder;

a resilient element provided between said thread holder and said engaging arm such that said engaging am, is capable of bending towards said thread holder to reduce a distance between said catch end of said engaging arm and said holding groove of said thread holder for providing a tension force on said loop of said tying thread, wherein said resilient element is a coil spring having two ends extended from said engaging arm and said thread holder respectively in such a manner that said resilient element provides an urging force against said engaging arm to bend towards said thread holder; and a handle frame rearwardly extended from said thread holding frame and aligned with said longitudinal axis, whereby, when said loop of said tying thread is tensely formed at said catch end of said engaging arm and said holding groove of said thread holder, said thread holding frame is rotated about an object via said handle frame such that said tying thread is coiled around said object with predetermined number of turns in a tensely tight manner, so that said loop of said tying thread is adapted to be released at said holding groove of said thread holder through said rounded bottom end thereof while said loop of said tying thread is retained by said engaging arm until said tying thread is released as said tying thread is drawn tight to form a final knot on said object.

3. A knot tying apparatus, comprising:

a thread holding frame having a longitudinal axis and comprising:

an engaging arm having a catch end positioning aligned with said longitudinal axis for slidably engaging a tying thread in position;

a thread holder, which is extended from said engaging arm, having a rounded bottom end axially extended from said longitudinal axis and an arc-shaped holding groove communicating with said rounded bottom end wherein said holding groove is adapted for slidably holding said tying thread to form a loop thereof while said tying thread is capable of being released at said rounded bottom end of said thread holder;

a resilient element provided between said thread holder and said engaging arm such that said engaging arm is capable of bending towards said thread holder to reduce a distance between said catch end of said engaging arm and said holding groove of said thread holder for providing a tension force on said loop of said tying thread, wherein said resilient element is a coil spring having two ends extended from said engaging arm and said thread holder respectively in such a manner that said resilient element provides an urging force against said engaging arm to bend towards said thread holder, wherein said thread holder comprises a first holder arm extended from said resilient element and a second holder arm integrally extended from said first holder arm to form a U-shaped structure with said rounded bottom end of said thread holder, wherein said second holder arm is bent to form said holding groove to communicate with said rounded bottom end of said thread holder; and a handle frame rearwardly extended from said thread holding frame and aligned with said longitudinal axis, whereby, when said loop of said tying thread is tensely formed at said catch end of said engaging arm and said holding groove of said thread holder, said thread holding frame is rotated about an object via said handle frame such that said tying thread is coiled around said object with predetermined number of turns in a tensely tight manner, so that said loop of said tying thread is adapted to be released at said holding groove of said thread holder through said rounded bottom end thereof while said loop of said tying thread is retained by said engaging arm until said tying thread is released as said tying thread is drawn tight to form a final knot on said object.

4. A knot tying apparatus, comprising:

a thread holding frame having a longitudinal axis and comprising:

an engaging arm having a catch end positioning aligned with said longitudinal axis for slidably engaging a tying thread in position;

a thread holder, which is extended from said engaging arm, having a rounded bottom end axially extended from said longitudinal axis and an arc-shaped holding groove communicating with said rounded bottom end wherein said holding groove is adapted for slidably holding said tying thread to form a loop thereof while said tying thread is capable of being released at said rounded bottom end of said thread holder;

a resilient element provided between said thread holder and said engaging arm such that said engaging arm is capable of bending towards said thread holder to reduce a distance between said catch end of said engaging arm and said holding groove of said thread holder for providing a tension force on said loop of said tying thread, wherein said resilient element is a coil spring having two ends extended from said engaging arm and said thread holder respectively in such a manner that said resilient element provides an urging force against said engaging arm to bend towards said thread holder, wherein said thread holder comprises a first holder arm extended from said resilient element and a second holder arm integrally extended from said first holder arm to form a U-shaped structure with said rounded bottom end of said thread holder, wherein said second holder arm is bent to form said holding groove to communicate with said rounded bottom end of said thread holder, wherein said engaging arm is frontwardly extended from said thread holder while said catch end of said engaging arm is shaped as a hook for securely engaging with said tying thread in position: and a handle frame rearwardly extended from said thread holding frame and aligned with said longitudinal axis, whereby, when said loop of said tying thread is tensely formed at said catch end of said engaging arm and said holding groove of said thread holder, said thread holding frame is rotated about an object via said handle frame such that said tying thread is coiled around said object with predetermined number of turns in a tensely tight manner, so that said loop of said tying thread is adapted to be released at said holding groove of said thread holder through said rounded bottom end thereof while said loop of said tying thread is retained by said engaging arm until said tying thread is released as said tying thread is drawn tight to form a final knot on said object.

5. The knot tying apparatus, as recited in claim 4, wherein said resilient element is integrally extended from said engaging arm to said thread holder so as to form a one-piece integral member of said thread holding frame.

6. A method of tying a knot on an object by using a knot tying apparatus, comprising the steps of:

(a) providing a thread holding frame which has a longitudinal axis and comprises an engaging arm having a catch end aligned with said longitudinal and a thread holder, which is axially extended from said longitudinal axis, having a holding groove formed thereon;

(b) forming a loop of a tying thread by slidably engaging the tying thread at said catch end of said engaging arm and slidably holding at said holding groove of said thread holder;

(c) axially aligning said longitudinal axis of said thread holding frame with respect to said object;

(d) rotating said thread holding frame such that said tying thread is coiled around said object;

(e) applying a tension force on said loop of said tying thread in such a manner that while coiling said tying thread around said object, said catch end of said engaging arm is pulled towards said holding groove of said thread holder to reduce a size of said loop of said tying thread while said loop of said tying thread is retained in a tensely tight manner;

(f) slidably releasing said tying thread at said holding groove of said thread holder while said catch end of said engaging arm still retains said loop of said tying thread, wherein said thread holder further has a rounded bottom end axially communicating with said holding groove such that said tying thread is released from said holding groove of said thread holder through said rounded bottom end thereof, wherein said thread holding frame is pivotally moved with respect to said longitudinal axis thereof until said tying thread is slid to said rounded bottom end of said thread holder; and (g) pulling a supply end of said tying thread away from said thread holding frame to gradually disappear said loop of said tying thread held at said catch end of said engaging arm, wherein once said catch end of said engaging arm is pulled close to said object, said catch end of said engaging arm is disengaged with said tying thread such that said coils of said tying thread are tightened by pulling said supply end of said tying thread along said object to complete said knot on said object.

7. A method of tying a knot on an object by using a knot tying apparatus, comprising the steps of:

(a) providing a thread holding frame which has a longitudinal axis and comprises an engaging arm having a catch end aligned with said longitudinal and a thread holder, which is axially extended from said longitudinal axis, having a holding groove formed thereon;

(b) forming a loop of a tying thread by slidably engaging the tying thread at said catch end of said engaging arm and slidably holding at said holding groove of said thread holder;

(c) axially aligning said longitudinal axis of said thread holding frame with respect to said object;

(d) rotating said thread holding frame such that said tying thread is coiled around said object;

(e) applying a tension force on said loop of said tying thread in such a manner that while coiling said tying thread around said object, said catch end of said engaging arm is pulled towards said holding groove of said thread holder to reduce a size of said loop of said tying thread while said loop of said tying thread is retained in a tensely tight manner, wherein said thread holding frame further comprises a resilient element provided between said engaging arm and said thread holder such that said engaging arm is capable of bending towards said thread holder to reduce a distance between said catch end of said engaging arm and said holding groove of said thread holder for providing said tension force on said loop of said tying thread;

(f) slidably releasing said tying thread at said holding groove of said thread holder while said catch end of said engaging arm still retains said loop of said tying thread, wherein said thread holder further has a rounded bottom end axially communicating with said holding groove such that said tying thread is released from said holding groove of said thread holder through said rounded bottom end thereof, wherein said thread holding frame is pivotally moved with respect to said longitudinal axis thereof until said tying thread is slid to said rounded bottom end of said thread holder; and (g) pulling a supply end of said tying thread away from said thread holding frame to gradually disappear said loop of said tying thread held at said catch end of said engaging arm, wherein once said catch end of said engaging arm is pulled close to said object, said catch end of said engaging arm is disengaged with said tying thread such that said coils of said tying thread are tightened by pulling said supply end of said tying thread along said object to complete said knot on said object.

* * * * *